US008087769B2

(12) United States Patent
Hiroki et al.

(10) Patent No.: US 8,087,769 B2
(45) Date of Patent: Jan. 3, 2012

(54) METHOD AND APPARATUS FOR FORMING IMAGE

(75) Inventors: Masashi Hiroki, Yokohama (JP); Satoshi Kaiho, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/721,120

(22) Filed: Mar. 10, 2010

(65) Prior Publication Data

US 2010/0165064 A1 Jul. 1, 2010

Related U.S. Application Data

(62) Division of application No. 11/619,720, filed on Jan. 4, 2007.

(51) Int. Cl.
*B41J 2/01* (2006.01)

(52) U.S. Cl. ..... 347/101

(58) Field of Classification Search ..... 347/17, 347/26

See application file for complete search history.

(56) References Cited

U.S. PATENT DOCUMENTS

| | | | | |
|---|---|---|---|---|
| 4,933,684 | A * | 6/1990 | Tasaki et al. | 347/17 |
| 6,382,759 | B2 * | 5/2002 | Maeda et al. | 347/17 |
| 2006/0139390 | A1 * | 6/2006 | Kruijt | 347/17 |
| 2008/0165215 | A1 | 7/2008 | Hiroki et al. | |
| 2008/0165218 | A1 | 7/2008 | Hiroki et al. | |
| 2008/0165220 | A1 | 7/2008 | Hiroki et al. | |
| 2008/0165231 | A1 | 7/2008 | Hiroki et al. | |
| 2008/0165238 | A1 | 7/2008 | Hiroki et al. | |
| 2008/0165239 | A1 | 7/2008 | Hiroki et al. | |
| 2008/0165240 | A1 | 7/2008 | Hiroki et al. | |
| 2008/0165241 | A1 | 7/2008 | Hiroki et al. | |
| 2008/0165242 | A1 | 7/2008 | Hiroki et al. | |

FOREIGN PATENT DOCUMENTS

| | | |
|---|---|---|
| JP | 2006-225075 | 8/2006 |
| JP | 2008-219235 | 8/2006 |

OTHER PUBLICATIONS

U.S. Office Action dated Dec. 9, 2010 corresponding to U.S. Appl. No. 11/619,720, 9 pages.
U.S. Office Action dated Oct. 6, 2009 corresponding to U.S. Appl. No. 11/619,720, filed Jan. 4, 2007.
U.S. Office Action dated Jul. 14, 2010 corresponding to U.S. Appl. No. 11/619,720, 11 pages.
U.S. Office Action dated Mar. 18, 2010 corresponding to U.S. Appl. No. 11/619,720, 8 pages.

* cited by examiner

*Primary Examiner* — Matthew Luu
*Assistant Examiner* — Justin Seo
(74) *Attorney, Agent, or Firm* — Turocy & Watson, LLP

(57) ABSTRACT

An image forming apparatus includes a carriage mounted with a recording head of an ink-jet system, a carriage driving mechanism, and a sheet conveying mechanism that conveys a sheet in a predetermined direction. The carriage is moved in a direction orthogonal to the conveying direction of the sheet by the carriage driving mechanism. A sheet guide member is arranged in a position below the recording head and opposed to the recording head. A sheet passes over a guide section of this sheet guide member. A heater is provided in the sheet guide member. This heater heats the guide section.

8 Claims, 4 Drawing Sheets

METHOD AND APPARATUS FOR FORMING IMAGE

CROSS-REFERENCE TO RELATED APPLICATIONS

This application is a Division of application Ser. No. 11/619,720 filed Jan. 4, 2007, the entire contents of which is hereby incorporated by reference.

BACKGROUND OF THE INVENTION

1. Field of the Invention

The present invention relates to an image forming apparatus for printing an image on a sheet such as a print sheet, and, more particularly to an image forming apparatus that has a recording head of an ink-jet system.

2. Description of the Related Art

In an image forming apparatus that has a recording head of an ink-jet system, when a sheet such as a print sheet passes near the recording head, a guide section that guides the sheet may be stained because of stains such as ink mist. However, since the guide section is fixed to a main body unit of the image forming apparatus, to clean the guide section, it is necessary to insert a cleaning tool from an opening of the main body unit toward the guide section. As other means for cleaning the guide section, paper (e.g., white paper) for cleaning is passed through the guide section to clean the stain of the guide section with this paper.

When the guide section is in the inner part of the main body unit of the image forming apparatus, it is difficult to remove the stain even if the cleaning tool is used. There is also a problem in that it is difficult to check whether the stain is removed. When the guide section is cleaned using the paper for cleaning, this is uneconomical because this paper is used for the purpose other than printing. In particular, in the image forming apparatus of the ink jet system, since an ink is consumed for maintenance of the recording head every time the recording head moves, there is a problem in that the ink is wastefully consumed. In both the cases, it is likely that the stain adhering to the guide section adheres to the sheet until the recording head is cleaned.

A technique for preventing ink mist from adversely affecting an image is described in JP-A-2006-219235. In the conventional technique, in an image forming apparatus including a conveyor belt that attracts a sheet with static electricity, static electricity with a voltage lower than an ink-mist attracting voltage is applied to the surface of the sheet when an image is printed on the sheet. However, in the conventional technique, a peak of power consumption is large because desired static electricity is applied to the sheet at the time of image formation. Moreover, an electric circuit and control for generating static electricity are necessary.

It is an object of the invention to provide an image forming apparatus and an image forming method that can prevent a sheet from being stained.

BRIEF SUMMARY OF THE INVENTION

The invention provides an image forming apparatus that prints an image on a sheet using a recording head of an ink-jet system. The image forming apparatus includes a carriage mounted with the recording head, a carriage driving mechanism including a motor for reciprocatingly moving the carriage, a sheet conveying mechanism that conveys the sheet in a direction orthogonal to a moving direction of the carriage, a sheet guide member that has a guide section arranged below the recording head and opposed to the recording head and in which the sheet passes over the guide section, and a heater that is provided in the sheet guide member and is capable of heating the guide section.

For example, in one aspect of the invention, the heater heats the guide section to temperature at which water in ink mist evaporates. In another aspect of the invention, the heater heats the guide section to temperature at which a solvent in ink mist evaporates.

Objects and advantages of the invention will become apparent from the description, which follows, or may be learned by practice of the invention.

BRIEF DESCRIPTION OF THE SEVERAL VIEWS OF THE DRAWING

The accompanying drawings illustrate embodiments of the invention, and together with the general description given above and the detailed description given below, serve to explain the principles of the invention.

DETAILED DESCRIPTION OF THE INVENTION

Figure 1:
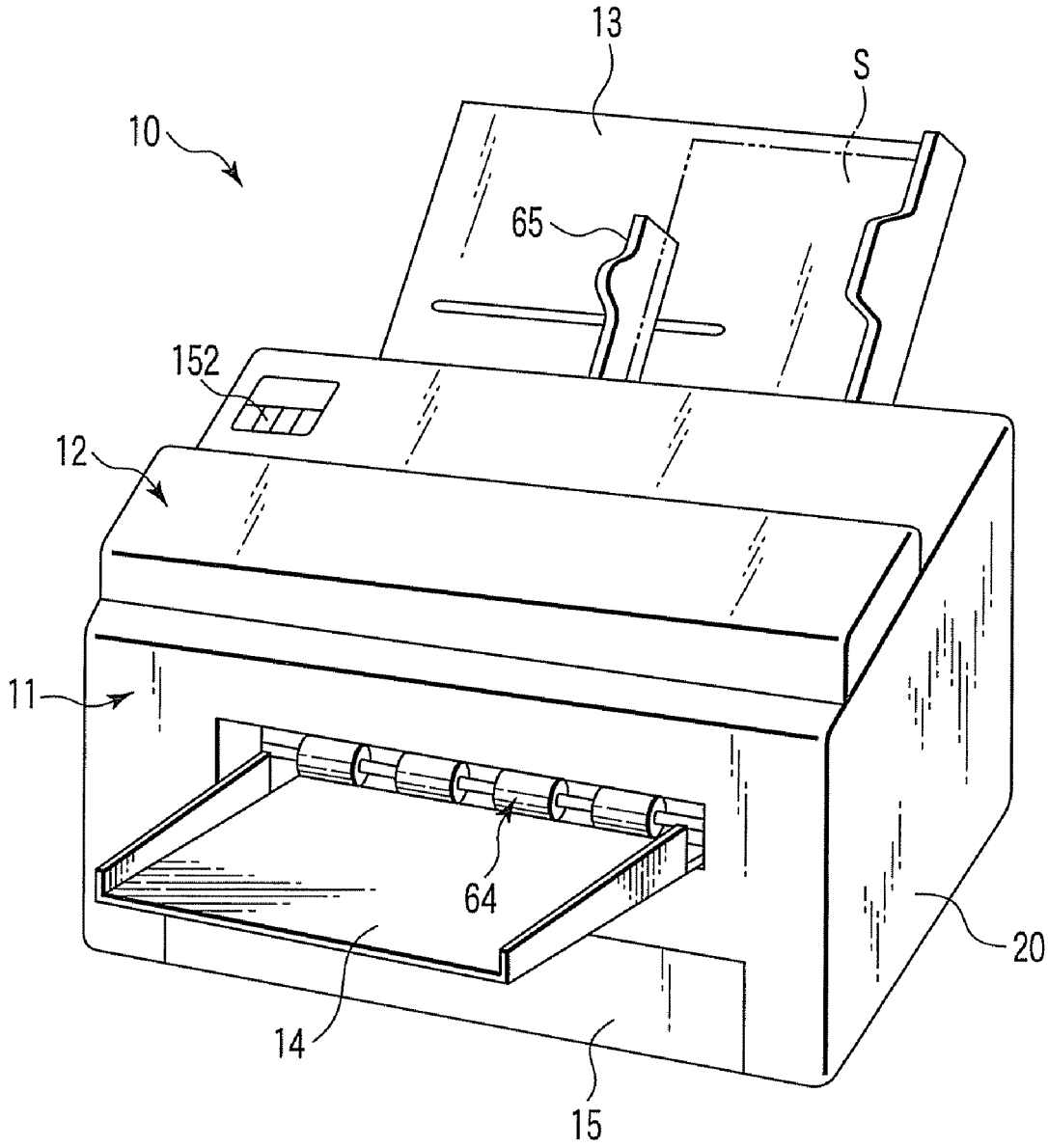
FIG. 1 is a perspective view of an image forming apparatus according to an embodiment of the invention.

An image forming apparatus according to an embodiment of the invention will be explained with reference to FIGS. 1 to 5. FIG. 1 shows an appearance of an image forming apparatus 10. This image forming apparatus 10 has a function of printing an image on a sheet such as a print sheet. As shown in FIG. 1, the image forming apparatus 10 has a main body unit 11, a head housing unit 12 arranged on the main body unit 11, a first feed tray 13 arranged in a rear part of the main body unit 11, a discharge tray 14 arranged in a front part of the main body unit 11, a second feed tray 15 housed in a lower part of the main body unit 11, and the like.

Figure 2:
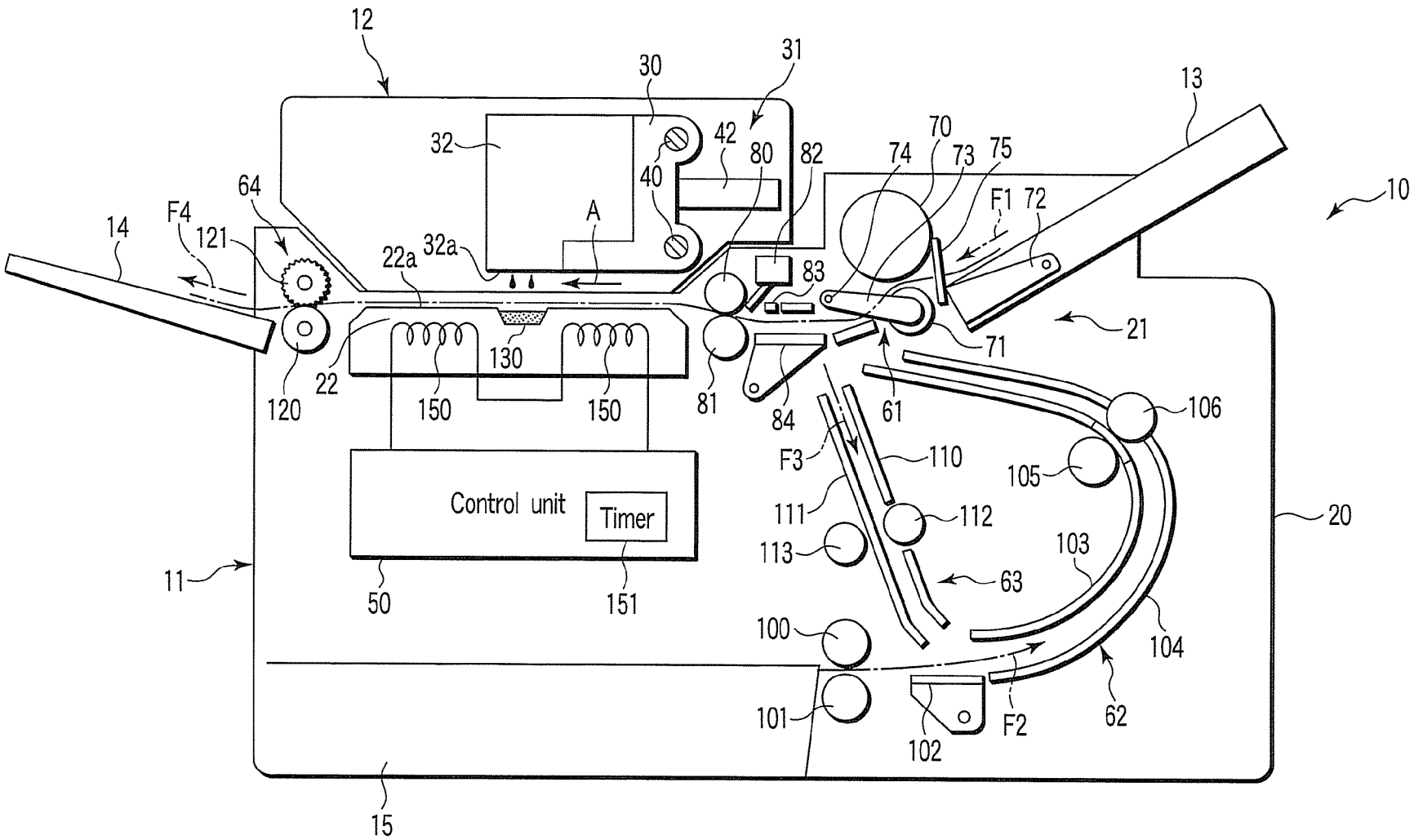
FIG. 2 is a side view schematically showing the inside of the image forming apparatus shown in FIG. 1.

FIG. 2 schematically shows the inside of the image forming apparatus 10. The main body unit 11 includes a housing 20, a sheet conveying mechanism 21 constructed in the inside of the housing 20, a sheet guide member 22 that has a guide section 22*a* in the horizontal direction, and a head maintenance unit 24 shown in FIG. 3. The sheet guide member 22 and the head maintenance unit 24 are explained in detail later.

A carriage 30, a carriage driving mechanism 31 for driving this carriage 30, a recording head 32 of an ink-jet system mounted on the carriage 30, and the like are arranged in the head housing unit 12. A replaceable ink cartridge (not shown) is housed in the recording head 32. As shown in FIG. 2, the recording head 32 has a nozzle section 32*a* opening downward to the guide section 22*a* of the sheet guide member 22 and an ink ejecting mechanism (not shown) that ejects an ink from the nozzle section 32*a*. The recording head 32 forms an image on a sheet S (shown in FIG. 3) with this ink. An arrow A in FIG. 3 indicates a conveying direction of the sheet S.

An example of the ink ejecting mechanism is a thermal type. The thermal type applies heat to the ink with a heater built in the recording head 32 to film-boil the ink. A pressure change is caused in the ink by growth or contraction of air bubbles due to this film boiling. An image is formed on the sheet S by ejecting the ink from the nozzle section 32*a* according to this pressure change. Other than the thermal type, for example, an ink ejecting mechanism that uses an element (e.g., a piezoelectric element) having a piezoelectric effect may be adopted. For example, the piezoelectric element is deformed by an electric current and an ink is ejected from a nozzle section according to a pumping action based on the deformation.

Figure 3:
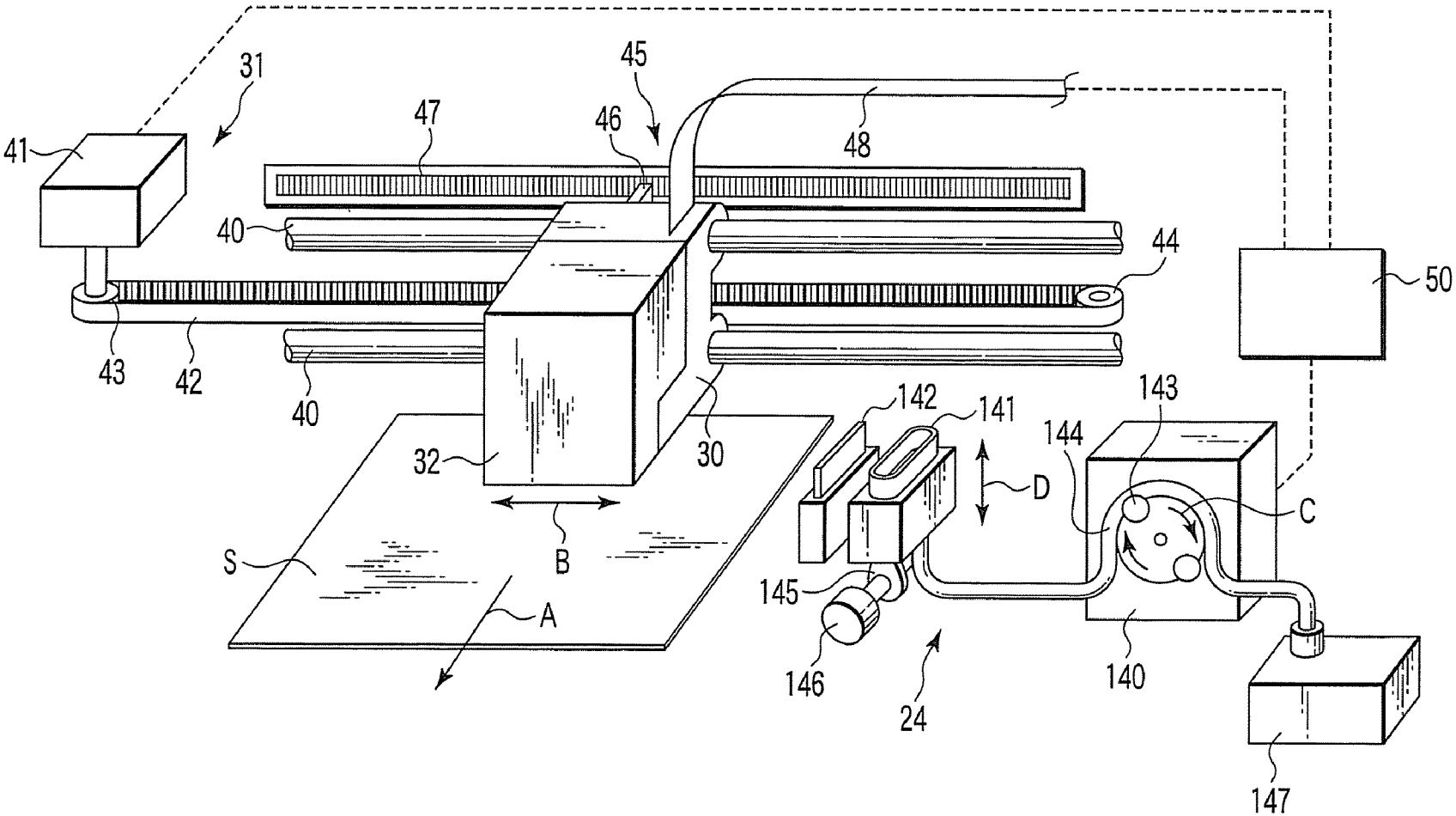
FIG. 3 is a perspective view of a carriage driving mechanism and a head maintenance mechanism of the image forming apparatus shown in FIG. 1.

As shown in FIG. 3, the carriage driving mechanism 31 includes a carriage guide 40 extending in the horizontal direction, a motor 41 such as a stepping motor, power transmitting members such as a timing belt 42 and sprockets 43 and 44, and a sensor unit 45 for controlling a position of the carriage 30. The carriage guide 40 extends in a direction B orthogonal to the conveying direction of the sheet S. The carriage guide 40 is supported by a frame of the head housing unit 12. The recording head 32 can reciprocatingly move in a direction (the arrow B direction) orthogonal to the conveying direction of the sheet S together with the carriage 30 along the carriage guide 40.

The rotation of the motor 41 is transmitted to the carriage 30 via the timing belt 42. Therefore, the recording head 32 reciprocatingly moves along the carriage guide 40. The sensor unit 45 for controlling a position of the carriage 30 includes, for example, an encoder sensor 46 and a ladder plate 47 serving as a section to be detected. The ladder plate 47 extends in a direction parallel to the carriage guide 40. The ladder plate 47 has a ladder pattern formed at equal pitches. The ladder pattern of the ladder plate 47 is optically detected by the encoder sensor 46 according to the position of the carriage 30, whereby the position of the carriage 30 is detected. A signal of the position detected is inputted to a control unit 50 via a flexible harness 48.

As shown in FIG. 2, the sheet conveying mechanism 21 includes a first conveying unit 61, a second conveying unit 62, a duplex-printing conveying unit 63 used in performing duplex printing, and a discharging mechanism 64. The first conveying unit 61 conveys a sheet taken out from the first feed tray 13 to the recording head 32. The second conveying unit 62 conveys a sheet taken out from the second feed tray 15 to the recording head 32. The discharging mechanism 64 has a function of discharging a sheet having an image printed thereon onto the discharge tray 14.

It is possible to place plural sheets (e.g., print sheets) on the first feed tray 13 stacking the sheets in the thickness direction. As shown in FIG. 1, a movable guide 65 is provided in the first feed tray 13. The movable guide 65 is movable in the width direction of the sheet S according to a size of the sheet S. It is possible to regulate a position in the width direction of the sheet S on the first feed tray 13 by moving the movable guide 65 in the width direction of the sheet S.

The first conveying unit 61 includes a feed roller 70, a separation roller 71 located below the feed roller 70, and a separation unit 72 including a separation pad. The feed roller 70 feeds a sheet taken out from the lower end of the first feed tray 13 to the recording head 32. A torque limiter is provided in the separation roller 71.

The separation roller 71 rotates in a direction identical with a direction of rotation of the feed roller 70 according to a function of the torque limiter when only one sheet is present between the separation roller 71 and the feed roller 70. When two or more sheets are present between the feed roller 70 and the separation roller 71, the separation roller 71 rotates in a direction opposite to the direction of rotation of the feed roller 70. Therefore, when plural sheets are taken out from the first feed tray 13 and fed into a space between the feed roller 70 and the separation roller 71, an uppermost sheet and the other sheets are separated and only the uppermost sheet is fed to the recording head 32. A sheet separating mechanism for taking out sheets from the first feed tray 13 one by one is constituted by the feed roller 70, the separation roller 71, the separation unit 72, and the like.

The separation roller 71 is held by a holder 73. The holder 73 is movable in the up-to-down direction around a shaft 74 extending in the horizontal direction. The separation roller 71 is brought into contact with the feed roller 70 at a predetermined load and separated from the feed roller 70 by a not-shown cam. It is possible to move the separation unit 72 in a direction toward and away from the feed roller 70 with a not-shown cam.

After the sheet is fed, the separation roller 71 and the separation unit 72 are separated from the feed roller 70, moved to standby positions, and put on standby until the next sheet feed time, respectively. A return lever 75 is rotatably arranged near the lower end of the first feed tray 13. When the sheet taken out from the first feed tray 13 is conveyed to the feed roller 70, the return lever 75 is retracted by a spring to a position where the return lever 75 does not hinder the conveyance of the sheet. This return lever 75 rotates in synchronization with the movement of the separation roller 71 and the separation unit 72 to the standby positions and feeds a remaining sheet back to the first feed tray 13.

The first conveying unit 61 includes a conveying roller 80, a pinch roller 81 opposed to this conveying roller 80, a sheet sensor 82, a media sensor 83, and a switching member 84. The conveying roller 80 feeds a sheet to a space between the sheet guide member 22 and the recording head 32. The sheet sensor 82 has a sensor arm that is capable of detecting positions of the leading end and the trailing end of the sheet.

The media sensor 83 has a function of detecting a quality (e.g., paper quality) and thickness of a sheet. For example, when the surface of the sheet is made of a material having moisture-absorption characteristics, the media sensor 83 outputs a signal for increasing a quantity of ink ejected from the recording head 32 to the control unit 50. In the case of a sheet having glossiness on the surface thereof, for example, coat paper, the media sensor 83 performs control for outputting a signal for reducing a quantity of ink ejected from the recording head 32 to the control unit 50. In the case of color printing, a ratio of ejection of plural color elements may be adjusted on the basis of a signal from the media sensor 83.

Figure 4:
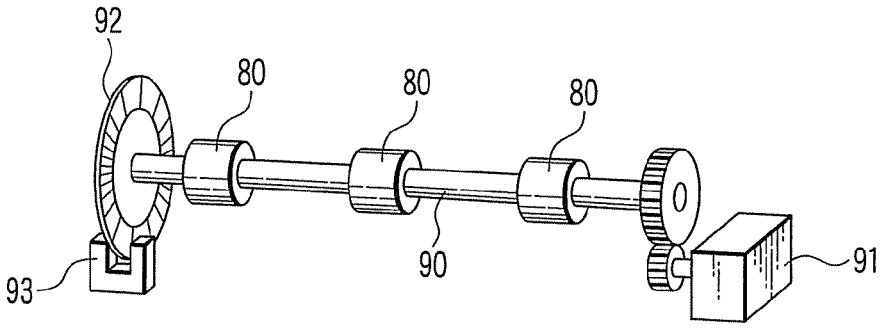
FIG. 4 is a perspective view of a part of a sheet conveying mechanism of the image forming apparatus shown in FIG. 1.

As shown in FIG. 4, the conveying roller 80 is attached to a shaft 90. The shaft 90 is rotated by a controllable motor 91 such as a stepping motor. The pinch roller 81 opposed to the conveying roller 80 is set in contact with the conveying roller 80 by a not-shown spring. A ladder wheel 92 of a disc shape is attached to the shaft 90 of the conveying roller 80. A ladder pattern is formed in a circumferential direction at fixed pitches in the ladder wheel 92. This ladder wheel 92 is detected by a sensor 93 and inputted to the control unit 50. Consequently, the rotation of the conveying roller 80 is controlled and conveyance of a sheet is controlled at the time of image formation.

A sheet taken out from the first feed tray 13 by the feed roller 70 is conveyed to a space between the conveying roller 80 and the pinch roller 81 through the first conveying unit 61 as indicated by an arrow F1 in FIG. 2. The leading end of the sheet is detected by the sheet sensor 82 and positioning for image formation is performed. This sheet passes between the upper surface (the guide section 22*a*) of the sheet guide member 22 and the recording head 32 according to the rotation of the conveying roller 80. When the sheet passes, an image is formed on the sheet S by the recording head 32. Ribs functioning as a conveyance reference surface are formed on the guide section 22*a* of the sheet guide member 22. These ribs keep the height of the sheet proper and prevent the sheet from heaving. The sheet having the image formed thereon is conveyed to the discharging mechanism 64.

The second conveying unit 62 includes rollers 100 and 101 for taking out a sheet from the second feed tray 15 of a cassette type, a switching member 102, guide members 103 and 104 for guiding the sheet taken out, a conveying roller 105 provided along the guide members 103 and 104, and a pinch roller 106 opposed to the conveying roller 105. The pinch roller 106 is pressed against the conveying roller 105 by a spring. It is possible to store plural sheets (e.g., print sheets) in the second feed tray 15 stacking the sheets in the thickness direction. The rollers 100 and 101 of the second conveying unit 62 function as sheet separating mechanisms for taking out sheets from the second feed tray 15 one by one.

A sheet taken out from the second feed tray 15 passes between the guide members 103 and 104 of the second conveying unit 62 through the switching member 102 as indicated by an arrow F2 in FIG. 2. This sheet is further conveyed to the conveying roller 80 by the rollers 105 and 106 and fed to the space between the recording head 32 and the sheet guide member 22.

The duplex-printing conveying unit 63 includes guide members 110 and 111, a conveying roller 112 provided along the guide members 110 and 111, and a pinch roller 113 opposed to the conveying roller 112. The pinch roller 113 is pressed against the conveying roller 112 by a spring. The guide members 110 and 111 are arranged between the switching member 84 of the first conveying unit 61 and the switching member 102 of the second conveying unit 62. At the time of duplex printing, a sheet is fed in an arrow F3 direction in FIG. 2. The conveying rollers 80, 105, and 112 are obtained by providing rubber-like resin such as EPDM (ethylene propylene diene rubber) on a metal shaft and have a function of conveying the sheet S with friction.

When duplex printing is performed, after an image is printed on one side of a sheet by the recording head 32, the trailing end of this sheet is detected by the sheet sensor 82. Immediately after the detection, the conveying roller 80 rotates reversely and a position of the switching member 84 is switched. Consequently, the sheet is sent to the duplex printing conveying unit 63 as indicated by the arrow F3 in FIG. 2. Moreover, this sheet is conveyed by the rollers 112 and 113 and passes between the guide members 103 and 104 of the second conveying unit 62 through the switching member 102. In this way, the front and the back of the sheet are reversed and this sheet is sent to the recording head 32 again by the conveying roller 80, whereby an image is printed on the other side of the sheet.

The discharging mechanism 64 has a discharge roller 120, a star wheel 121, a transmitting mechanism (not shown) for transmitting the rotation of the conveying roller 80 to the discharge roller 120 and the star wheel 121, and the like. The star wheel 121 is a wheel of a gear shape made of a thin plate of stainless steel or the like. A sheet having an image printed thereon by the recording head 32 is conveyed in a direction indicated by an arrow F4 to the discharge tray 14 while being pressed against the discharge roller 120 by the star wheel 121. The sheet after printing is prevented from floating from the discharge roller 120 by this start wheel 121.

Figure 5:
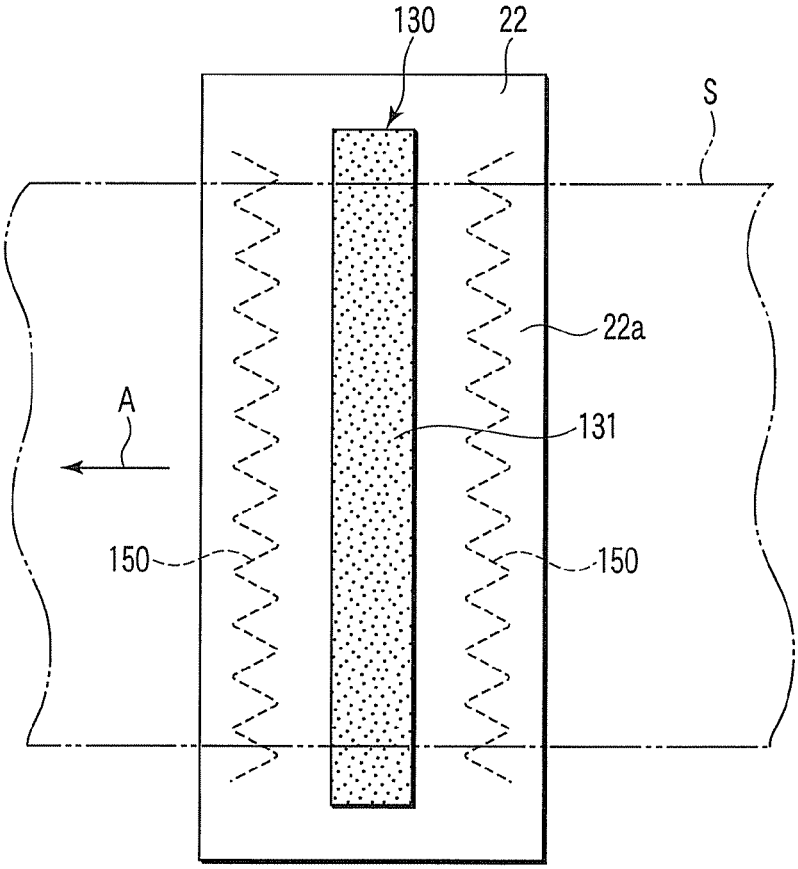
FIG. 5 is a plan view of a sheet guide member of the image forming apparatus shown in FIG. 1.

As shown in FIG. 5, an ink absorbing section 130 is formed on the upper surface side of the sheet guide member 22. The ink absorbing section 130 is opposed to the nozzle section 32*a* (shown in FIG. 2) of the recording head 32 and formed in a position lower than the guide section 22*a*. The width of the ink absorbing section 130 is larger than the width of the sheet S. For example, a sponge-like ink absorbing member 131 is housed in the ink absorbing section 130. When rimless printing on a sheet is performed, an excess ink ejected on the outside of the edge of the sheet is absorbed by this ink absorbing member 131, whereby following sheets are prevented from being stained.

The head maintenance unit 24 shown in FIG. 3 includes a suction device 140 for performing cleaning of the recording head 32, a cap 141 for preventing the recording head 32 from drying, and a blade member 142 for cleaning the nozzle section 32*a* of the recording head 32. An example of the suction device 140 strokes a tube 144 in a direction indicated by an arrow C with a body of rotation 143 to generate a negative pressure on the inner side of the cap 141.

It is possible to move the cap 141 in an up-to-down direction (an arrow D direction in FIG. 3) with a cap driving unit 145. The cap driving unit 145 moves the cap 141 up and down with an actuator 146 such as a solenoid as a driving source. The rotation of a motor may be converted into a linear motion by a cam, a link mechanism, or the like to move the cap 141 up and down. In maintaining the recording head 32, the cap 141 is lifted to the recording head 32 to bring the cap 141 into close contact with the recording head 32. In this state, the suction device 140 is actuated to suck an excess ink adhering to the nozzle section 32*a* of the recording head 32. The waste ink sucked is discharged into a waste ink tank 147. Thereafter, the cap 141 moves away from the recording head 32 and the nozzle section 32*a* of the recording head 32 is cleaned by the blade member 142.

As shown in FIG. 5, a heater 150 is arranged in the sheet guide member 22. This heater 150 can heat the upper surface of the sheet guide member 22, i.e., the guide section 22*a*. Although a position of the heater 150 is not limited, the heater 150 is provided, for example, around the ink absorbing section 130. The heater 150 is connected to the control unit 50 to control an electric current and can heat the guide section 22*a* to a predetermined temperature. The control unit 50 includes a timer for supplying an electric current to the heater 150 for a fixed time. The control unit 50 may include a temperature sensor for detecting the temperature near the guide section 22*a*.

In a first embodiment, when the recording head 32 is not performing an image forming operation, the control unit 50 controls an electric current to the heater 150 to heat the guide section 22*a* to 120° C. to 300° C. with the heater 150. Consequently, temperature near the guide section 22*a* and the recording head 32 is kept at a desired temperature. An "image forming operation" in this specification means the time when the carriage 30 moves while an ink is ejected from the recording head 32, whereby an image is formed on a sheet. On the other hand, a "printing operation" is a concept including, other than the image forming operation, the time when a sheet is conveyed by the sheet conveying mechanism 21.

As shown in FIG. 2, the control unit 50 includes a timer 151. The timer 151 turns off the heater 150 when a state in which the image forming operation is not performed lasts for a predetermined time. It is possible to input the predetermined time (e.g., several minutes) set in the timer 151 to the control unit 50 with an operation panel 152 shown in FIG. 1. The timer 151 may turn off the heater 150 when a non-printing operation of the image forming apparatus 10 lasts for the predetermined time. In the case in which the image forming apparatus 10 has a power save mode, the heater 150 may be turned off when the image forming apparatus 10 shifts to the power save mode.

Main components of an ink ejected from the recording head 32 are a pigment, water, and a solvent (e.g., glycerin). When an ink is heated to about 120° C., viscosity of the ink rises because the water evaporates. Moreover, when this ink is heated to 300° C. or more, the solvent also evaporates. In this embodiment, the neighborhood of the guide section 22*a* is heated by the heater 150 for a predetermined time to have temperature equal to or higher than 120° C. and equal to or lower than 300° C. When the neighborhood of the guide section 22*a* is heated to 120° C. or more, moisture in ink mist formed by the ink ejected from the recording head 32 evaporates. Therefore, a quantity of ink mist floating between the recording head 32 and the sheet guide member 22 decreases. Since the quantity of ink mist decreases, it is possible to prevent following sheets from being stained.

In the recording head 32 of the thermal type, since an electric current is supplied to the heater in the recording head 32 at the time of image formation, power consumption temporarily increases. In this embodiment, since an electric current is not supplied to the heater 150 of the sheet guide member 22 at the time of image formation, it is possible to prevent a peak of power consumption from becoming excessively high. Since a heating temperature is set near 120° C., it is possible to arrange a temperature environment near the recording head 32 and stabilize performance of an ink.

In a second embodiment, when a printing operation is not performed, i.e., when image formation by the recording head 32 is not performed and the sheet conveying mechanism 21 is not operating, the guide section 22*a* is heated to 300° C. or more for a predetermined time by the heater 150. Consequently, water and a solvent in ink mist present near the guide section 22*a* evaporate and ink mist adhering to the guide section 22*a* and the like solidifies. Therefore, it is possible to prevent following sheets from being stained by the ink mist.

When the guide section 22*a* is always heated to 300° C. or more, it is likely that the temperature near the recording head 32 also rises and an ink in the recording head 32 also solidifies. Therefore, heating by the heater 150 is performed for a fixed time according to a timer function of the control unit 50 when a printing operation on a sheet is not performed. When the control unit 50 includes a temperature sensor, the temperature of the guide section 22*a* is inputted to the control unit 50 and an electric current supplied to the heater 150 is controlled, whereby the guide section 22*a* is maintained at the temperature.

As explained above, the respective embodiments include the following steps:

conveying the sheet S in a predetermined direction by the sheet conveying mechanism 21; moving the recording head 32 in a direction orthogonal to the conveying direction of the sheet S with the carriage driving mechanism 31; forming an image on the sheet S by ejecting an ink from the recording head 32 to the sheet S; and heating the guide section 22*a* of the sheet guide member 22 opposed to the recording head 32 to 120° C. or more with the heater 150. These steps are executed on the basis of a computer program stored in the control unit 50.

According to the embodiments, it is possible to prevent a sheet from being stained by ink mist near the recording head 32 in the image forming apparatus 10 or reduce the stain. Therefore, it is possible to reduce frequency that a user performs cleaning of the guide section 22*a*. Since timing for heating the guide section 22*a* with the heater 150 is set at time except the time of image formation or a printing operation, it is possible to prevent a peak of power consumption from becoming excessively high.

It is also possible to apply the invention to an image forming apparatus for printing an image on sheets other than a print sheet, for example, sheets made of paper of various forms, cloth, plastics, and the like.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the invention as defined by the appended claims and equivalents thereof.

What is claimed is:

1. An image forming method of printing an image on a sheet with a head portion of an ink-jet system, the image forming method comprising:

conveying the sheet in a conveying direction; moving the head portion in a direction orthogonal to the conveying direction of the sheet;

forming an image on the sheet by ejecting an ink from the head portion to the sheet; and heating a sheet guide section opposed to the head portion with a heater provided in a sheet guide member if the sheet is not conveyed, the head portion is not moved and the head portion is not ejecting the ink; and stopping heating the sheet guide section if the sheet is conveyed, the head portion is moved or the head portion is ejecting the ink.

2. An image forming method according to claim 1, wherein the sheet guide section is heated to a temperature at which water in ink mist generated by an ink ejected from the head portion evaporates.

3. An image forming method according to claim 1, wherein the sheet guide section is heated to a temperature at which a solvent in ink mist generated by an ink ejected from the head portion evaporates.

4. An image forming method according to claim 1, wherein the heater is turned off when a state in which an image forming operation is not performed lasts for a predetermined time.

5. An image forming method according to claim 1, wherein the heater is turned off when a non-printing operation state lasts for a predetermined time.

6. An image forming apparatus that prints an image on a sheet with means for recording in an ink-jet system, the image forming apparatus comprising:

means for conveying the sheet in a conveying direction;

means for moving the means for recording in a direction orthogonal to the conveying direction of the sheet;

means for forming an image on the sheet by ejecting an ink from the means for recording to the sheet;

means for heating a means for guiding the sheet opposed to the means for recording, the means for heating being provided in the means for guiding the sheet; and means for controlling the means for heating, the means for heating heats the means for guiding the sheet if the sheet is not conveyed, the means for recording is not moved and the means for recording is not ejecting the ink, and the means for heating stops heating the means for guiding the sheet if the sheet is conveyed, the means for recording is moving or the means for recording is ejecting the ink.

7. An image forming apparatus according to claim 6, wherein the heating means heats the sheet guide means to a temperature at which water in ink mist generated by an ink ejected from the recording means evaporates.

8. An image forming apparatus according to claim 6, wherein the heating means heats the sheet guide means to a temperature at which a solvent in ink mist generated by an ink ejected from the recording means evaporates.

* * * * *